United States Patent [19]

Burnight et al.

[11] 3,978,771

[45] Sept. 7, 1976

[54] MECHANICAL PISTON RETENTION FOR FREE WHEELING

[75] Inventors: Thomas R. Burnight; Donald A. Holtkamp, both of Battle Creek, Mich.

[73] Assignee: Clark Equipment Company, Buchanan, Mich.

[22] Filed: Apr. 21, 1975

[21] Appl. No.: 570,335

[52] U.S. Cl. ..... 91/491; 92/26; 92/30

[51] Int. Cl.[2] ..... F01B 13/06

[58] Field of Search ..... 91/491, 497, 501; 92/26, 30

[56] References Cited

UNITED STATES PATENTS

| | | | |
|---|---|---|---|
| 2,295,961 | 9/1942 | Meyer | 92/26 |
| 3,166,990 | 1/1965 | Hoffmann | 92/30 |
| 3,283,668 | 11/1966 | Louhio | 91/44 |
| 3,733,971 | 5/1973 | Sugimoto | 92/26 |
| 3,824,899 | 7/1974 | Dzioba | 180/66 F |

FOREIGN PATENTS OR APPLICATIONS

| | | | |
|---|---|---|---|
| 1,199,870 | 12/1959 | France | 91/501 |
| 1,249,873 | 11/1960 | France | 91/491 |

*Primary Examiner*—William L. Freeh
*Attorney, Agent, or Firm*—John C. Wiessler

[57] ABSTRACT

A fixed displacement fluid motor or pump of the ball or roller piston type in which a plurality of axially or radially extending reciprocating pistons coact with a cam track to produce output motion or to generate pressure fluid output, respectively. A mechanical locking device, preferably in the form of an expansible retaining ring, is secured to each piston, being adapted to lock the piston in a fixed retracted position and out of contact with the cam in a tapered portion of the cylinder bore in modes of operation during which no motor or pump output is required.

4 Claims, 5 Drawing Figures

MECHANICAL PISTON RETENTION FOR FREE WHEELING

BACKGROUND OF THE INVENTION

We incorporate by reference herewith the statement of Background of the Invention appearing in the commonly assigned co-pending U.S. application Ser. No. 519,962, filed Nov. 1, 1974, in the name of Thomas R. Burnight, one of the co-inventors of the present application.

SUMMARY

Our invention is capable of numerous embodiments or forms in respect of the type of fluid used in various types of motors and pumps, as set forth in the Background above referred to; it solves the types of exemplary problems there stated in respect of numerous applications in which such types of fluid motors or pumps may be utilized.

The present invention provides an alternative construction to that of the above referenced co-pending application, in which a structurally simple and relatively low cost mechanical locking device is used under certain operational conditions to hold such pistons in any such types of motors or pumps in retracted positions out of contact with the cam track and stationary in the cylinders in which they normally reciprocate.

It is therefore a primary object of the invention to provide a mechanical means for effectively disengaging pistons from the cam track of any such fixed displacement fluid type motor or pump.

It is a further object to provide in such motor or pump types extremely simple and low cost mechanical means for holding the pistons in fixed retracted positions during certain operational modes.

DESCRIPTION OF THE PREFERRED EMBODIMENT

Figure 1:
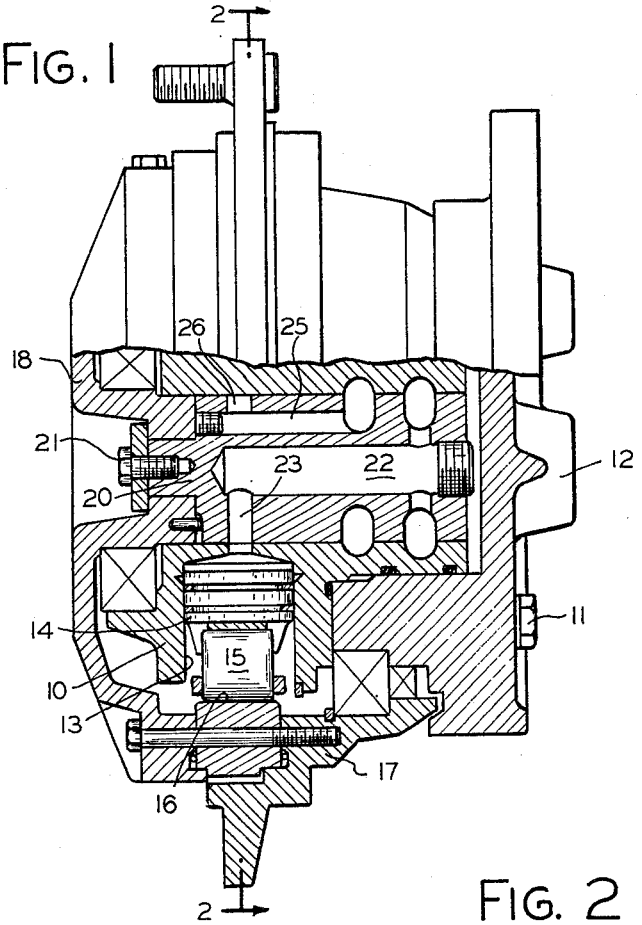
FIG. 1 is a partial cross-sectional view of a radial piston motor or pump of the axial roller piston type.
Figure 2:
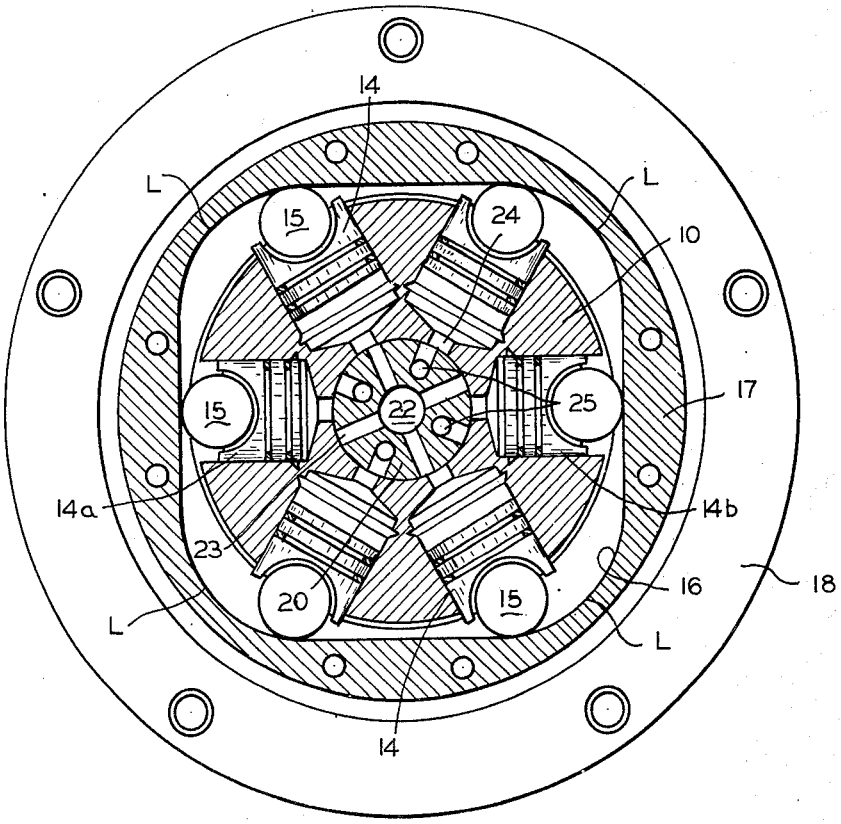
FIG. 2 is a cross-sectional view taken along line 2—2 of FIG. 1.

FIGS. 1 and 2 show an exemplary embodiment of a positive-displacement fluid pressure machine, operable as a pump or motor, of the type having a plurality of reciprocating pistons sliding in cylinders which travel together, linearly or angularly, relative to a cam which extends transversely to the axes of piston movement, the pistons having cam followers which co-act with the cam as the pistons reciprocate and which traverse each portion of the profile of the cam in succession.

A hydrostatic wheel motor is illustrated which comprises a non-rotatable cylinder block 10 mounted fixedly by means of a ring of bolts 11 on an axle 12 formed with six radial cylinders 13 at 60° angular spacings. In each cylinder is a piston 14 carrying a cylinderical cam follower roller 15 which co-acts with a cam track 16 positioned in the interior of a wall 17 of a wheel hub assembly 18. Pistons 14 co-acts with the cam track 16, and the wheel hub assembly 18 is journaled suitably on the axle 12 for rotation by the co-action of the piston follower 15 with the cam track.

A valving pintle 20 is secured to the wheel hub assembly 18 by means of a bolt 21 for rotation therewith in a central bore in the fixed cylinder block 10, and is provided with a central fluid supply passage 22 to which pressure fluid is supplied, and with radial supply ports 23 which cooperate with inlet ports 24 in the cylinder block leading into cylinders 13. The pintle 20 also has axial discharge passages, one of which is shown at 25, each having a radial discharge passage 26 also cooperating with inlet ports 24. The supply passages 23 and the discharge passages 26 alternate angularly, as viewed in FIG. 2, so that as the pintle 20 rotates each cylinder in turn is first supplied with pressure fluid to drive the respective piston radially outwardly through its working stroke, and is then connected to the discharge passage to allow the escape of fluid and the inward return stroke of the piston, which is maintained in continuous contact with the cam track. The axial supply and return passages 22 and 25 are respectively connected to pressure fluid supply and return connections (not shown) on the axle 12.

The profile of each of the four cam lobes L of the cam track 16 is comprised of two halves which are mirror images of one another and subtend 45° apiece at the motor axis. As the hub assembly 18 rotates with the cam tracks 16 and pintle 20 about the fixed cylinder block 10, the cylinders will be supplied with pressure fluid in turn from the pintle supply ports 23, appropriate cylinders being energized as required to provide the working strokes of respective pistons 14. During the working stroke each piston will co-act through its follower rollers 15 with one-half of a cam lobe L along which half the roller 15 will travel relatively to the cam track 16 as the piston 14 is driven outwardly by the fluid pressure acting on its face. As shown, the pistons are actuated to fully extended positions as they traverse the four lobe sections of the cam track, and are actuated to fully retracted operational positions as they traverse the central portions between pairs of lobes. The construction of the motor as described above in respect of FIGS. 1 and 2 is conventional.

The motor as disclosed in FIGS. 1 and 2 is merely representative of one pump or motor type in which the invention to be now described in conjunction therewith may be utilized. For example, the invention may be applied to a ball piston pump or motor such as disclosed in U.S. Pat. No. 3,561,329, or any one of a variety of radially actuated piston rotary motor or pump types in which the pistons are actuated in reciprocatory motion by a cam track, and in which either the cam track or the cylinder block may be rotated, depending upon the particular application.

Figure 3:
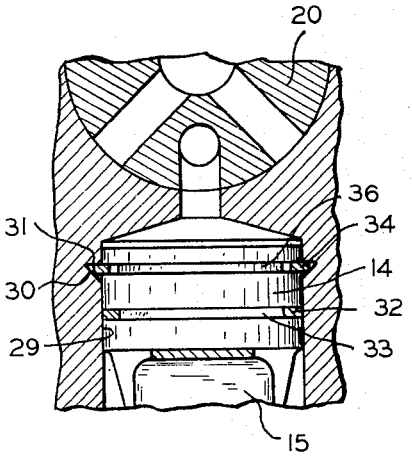
FIG. 3 is an enlarged sectional view of a portion of one of the piston-cylinder units shown in FIGS. 1 and 2.

In FIGS. 1–3 we have combined in the hydrostatic pump or motor as disclosed a mechanical means for securing all of the pistons in a fully retracted condition during rotation of the wheel with hub assembly 18, such as in a freewheeling situation in which an off-the-road tractor is being towed at highway speeds, it being essential under such conditions to effectively deactivate the pump or motor in such a manner that the pistons remain fully retracted and out of contact with the cam track during rotation thereof.

As illustrated in FIGS. 1 and 2, we are able to effect this result by means of a simple, low cost mechanical locking device. Each of the bores of cylinders 13 comprises a main cylindrical portion 29, adjacent the inner end of which is an outwardly tapered annular portion 30 having a shoulder 31. A split sealing ring 32 is located in an annular groove 33 of each of the pistons, and a split locking or retaining ring 34 is located radially inwardly in spaced relation to ring 32 in a second groove 36 of each piston.

In normal operation as a motor the pistons reciprocate under pressure and are actuated when fully retracted so that each locking ring 34 is actuated to within a fractional-inch distance of the radially outward annular edge of each tapered portion 30 by the action of the rotating cam 16, as shown in FIG. 1, and also as shown at pistons 14*a* and 14*b* in FIG. 2. The supply pressure from a hydraulic system charging or supply pump, not shown, actuates the pistons outwardly of the cylinder from full operational retraction to maximum extension which occurs in the lobe sections of the motor while the rollers 15 remain in constant contact with the surface of the cam track.

Preparatory to towing the tractor at highway speeds, for example, the tractor drive train is, of course, immobilized so that the hydrostatic motor at each wheel receives no fluid pressure supply from the supply or charging pump. Under these conditions locking rings 34 and tapered portions 30 cooperate to lock the pistons in positions inwardly of normal full retraction. The pistons are propelled into such locked-in positions as each is actuated by the rotating cam to the inner end of the respective cylinder as follows: Upon release of cylinder pressure, including charging pressure, each piston is actuated inwardly by the usual camming action during rotation, but the inward momentum of the piston following dissipation of cylinder pressure propels it inwardly to a position in which locking ring 34 moves and expands into tapered portion 30, in which position the piston is locked by ring 34 against radial outward movement until the cylinder is again pressurized. The mechanical lock occurs by the expansion of the locking ring engaging the outward taper of the bore, it being normally actuated in this condition into abutment with shoulder 31 of each tapered portion 30. The tapered portion is designed so that the force of engagement between the wall thereof and the locking ring is sufficient to hold the piston in the retained position against road shock forces and the like during operations when the pump or motor is in a free-wheeling condition.

The design is such that during such free-wheeling operation the rollers 15 do not contact any portion of the cam surface 16 thereby avoiding completely the wear and tear, heating, drag and reciprocatory motion of the pistons, as well as avoiding damage to or even destruction of a motor wherein the pistons are not thus deactivated, but are reciprocated as in normal operation but not under load at much higher than design or rated speed, as in towing operations at highway speeds.

When the supply or charging pump is in operation the pressure fluid in the cylinder is sufficient to actuate the pistons causing disengagement of the locking rings from the tapered portions, whereupon the pump or motor operates again in a normal manner.

Figure 4:
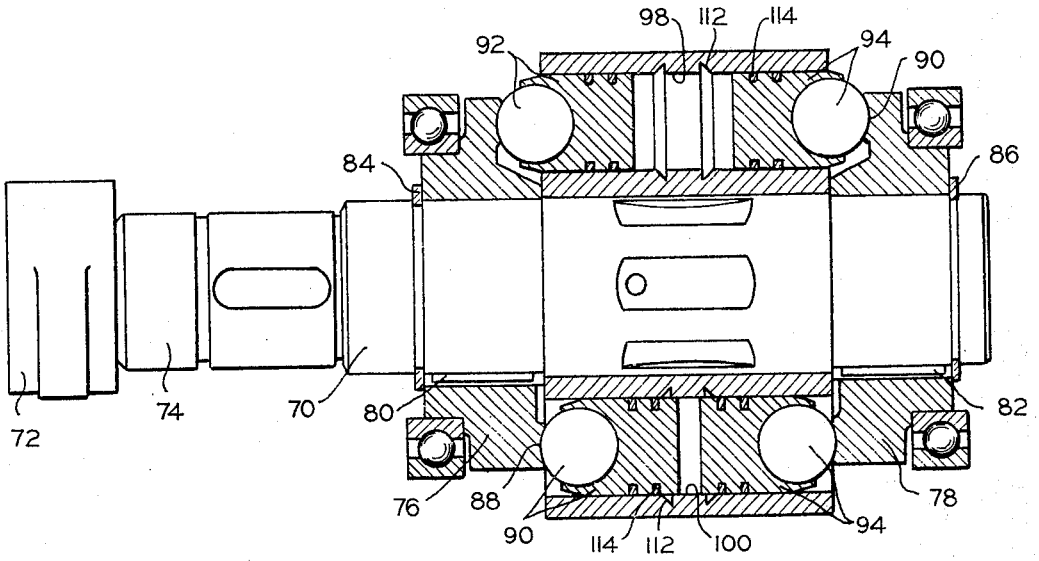
FIG. 4 is a longitudinal sectional view of a modification showing a portion of an axial piston fluid motor pump which embodies our invention.

Referring to FIG. 4, a longitudinal sectional view of the essential working parts of an opposed cam actuated axial piston pump or motor is shown; it is of a type such as is manufactured by Carron Hydraulics of Carron, Falkirk, Scotland. A drive shaft is shown at 70 having an inlet and outlet porting block 72 connected thereto by a threaded collar 74; a pair of camming plates 76 and 78 are key connected to the drive shaft at 80 and 82 by snap rings 84 and 86.

The cam plates 76 and 78 have cam races 88 and 90 engaging a plurality of pairs of circumferentially spaced opposed pistons 92 and 94. The pairs of pistons are mounted in respective axially extending, circumferentially spaced cylinders 98 and 100 in the pump or motor body, hydraulic fluid entering into and discharging from such cylinders by way of suitable porting means in the shaft and in the pump body, details of which need not be described herein. All of the cylinders are suitably mounted on shaft 70, two of them being shown in the section of FIG. 4.

Figure 5:
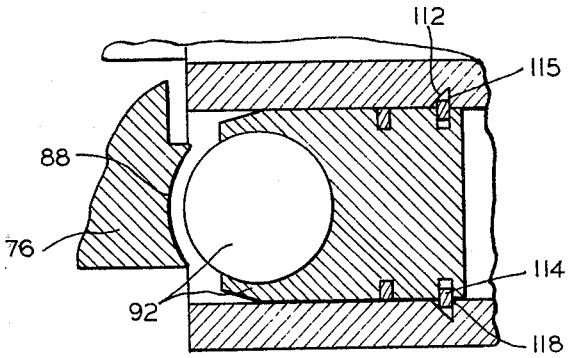
FIG. 5 is an enlarged sectional view of a portion of the piston-cylinder construction of FIG. 4, showing the piston in a retracted locked position.

As in the radial piston motor of FIGS. 1–3, the cylinders of the axial piston pump or motor of FIGS. 4 and 5 include axially inwardly extending tapered extensions of the cylinders as shown at numeral 112 adapted to cooperate with piston locking rings 114 in the same manner as described above in respect of FIGS. 1—3. The lower pair of opposed pistons 92 and 94, as shown, are actuated into normal operational full inward stroke positions in continuous contact with the cam races. In FIG. 5 the piston is shown in its locked retracted position out of contact with cam race 88, the pressure in the cylinders having been relieved for free-wheeling, and, as in FIGS. 1–3, the momentum of the pistons having projected them into positions such as illustrated by the one piston in FIG. 5 wherein locking ring 114 is in abutment with shoulder 115. As in FIGS. 1–3, the pistons are maintained out of contact with the cam races throughout such operation.

It will be apparent to those skilled in the art that various changes in the structure and relative arrangement of parts may be made without departing from the scope of our invention.

We claim:

1. A fixed displacement fluid pump or motor having a plurality of pistons reciprocable in a plurality of cylinders, means normally in driving or driven contact with said pistons, valve means operable normally to cycle pressure fluid to said cylinders to operate said pistons and to prevent the pistons from being actuated out of contact with said driving or driven means, outwardly tapered wall means formed in each of said cylinders axially inwardly of the normal inner ends of the strokes of the respective pistons, locking means located on the respective pistons adapted to lockingly engage said tapered wall means in a free-wheeling condition of operation in which said pistons are actuated by inward momentum thereof only under certain conditions of relatively low fluid operating pressure in said cylinders to positions inwardly of one ends of the normal piston strokes wherein said locking means engage said tapered wall means, the pressure fluid conducted to said cylinders by said valve means in normal operation preventing the locking means from engagement with said tapered wall means, said pistons being actuated normally by said driving or driven means into positions closely spaced from the tapered wall means, said locked condition of said pistons under said condition of relatively low fluid operating pressure in said cylinders causing said pistons to be held continuously in positions out of contact with said driving or driven means.

2. A fluid pump or motor as claimed in claim 1 wherein said driving or driven means is camming means and said pistons include balls or rollers adapted normally to be in continuous contact with said camming means.

3. A fluid pump or motor as claimed in claim 1 wherein said piston include pairs of opposed pistons, each pair of which adjacent the inner ends thereof provide said tapered wall means, said locking means being adapted to hold each such pair of piston retracted adjacent relationship and continuously out of contact with said driving or driven means.

4. A fluid pump or motor as claimed in claim 1 wherein said wall means tapers radially outwardly of each cylinder and said locking means is an expansible ring element mounted circumferentially of each piston and adapted to expand outwardly into locking engagement with said tapered wall means in said free-wheeling condition.

* * * * *